US007188634B2

(12) United States Patent
Coakley, Sr.

(10) Patent No.: US 7,188,634 B2
(45) Date of Patent: Mar. 13, 2007

(54) CANE WITH IMPROVED FOOT AND HANDLE CONSTRUCTION

(76) Inventor: John A. Coakley, Sr., 1810 Benedict Rd., Westminster, MD (US) 21157

( * ) Notice: Subject to any disclaimer, the term of this patent is extended or adjusted under 35 U.S.C. 154(b) by 499 days.

(21) Appl. No.: 10/794,832

(22) Filed: Mar. 4, 2004

(65) Prior Publication Data

US 2004/0177873 A1 Sep. 16, 2004

Related U.S. Application Data

(60) Provisional application No. 60/454,796, filed on Mar. 13, 2003.

(51) Int. Cl.
*A61H 3/00* (2006.01)
*A45B 9/02* (2006.01)

(52) U.S. Cl. ..... 135/76; 135/77; 135/86

(58) Field of Classification Search ..... 135/70, 135/77, 82, 86, 76, 72; 16/111.1; 81/490
See application file for complete search history.

(56) References Cited

U.S. PATENT DOCUMENTS 1,340,616 A * 5/1920 Lynde ..... 135/86
4,899,771 A * 2/1990 Wilkinson ..... 135/77
5,713,382 A * 2/1998 Midcap ..... 135/84
5,722,445 A * 3/1998 Hae et al. ..... 135/65
5,845,664 A * 12/1998 Ryder et al. ..... 135/65
7,087,002 B2 * 8/2006 Montgomery ..... 482/121
2004/0144410 A1 * 7/2004 Cheng et al. ..... 135/65

* cited by examiner

*Primary Examiner*—Tamara L Graysay
*Assistant Examiner*—Danielle Jackson
(74) *Attorney, Agent, or Firm*—Ober/Kaler; Royal W. Craig

(57) ABSTRACT

A cane comprising a shaft, an ergonomic handle that includes multiple storage/retention zones, an emergency assist handle, and an ergonomically enhanced tip, or foot. The emergency assist handle, when inserted into one of two sleeves located in the shaft, provides a user with a means for rising from the ground after a fall. The ergonomic handle of the present invention includes a compartment, or retention zone, into which any number of small, hand-held devices and may be inserted and is formed with an external, textured material that helps the cane to resist falling over when leaned against virtually any vertical surface at angles not precisely perpendicular to the ground. The elongated foot of the present invention is radically different in size, length, and configuration and, thereby increases the area in contact with the surface being traversed by a user by up to 200%, without changing the "feel" of the cane. The present invention is fabricated of lightweight materials chosen to provide an appropriate degree of durability/longevity. The present invention possesses a simple, yet scalable, design that may be economically manufactured and sold to provide for widespread use.

27 Claims, 5 Drawing Sheets

CANE WITH IMPROVED FOOT AND HANDLE CONSTRUCTION

CROSS-REFERENCE TO RELATED APPLICATIONS

The present application derives priority from U.S. Provisional Patent Application Ser. No. 60/454,796, filed Mar. 13, 2003.

BACKGROUND OF THE INVENTION

1. Field of the Invention

The present invention relates to canes used by individuals as an aid to the walking process and, more particularly, to, and even more particularly, to improved tip and handle designs for walking canes for enhanced mobility.

2. Description of the Background

Canes (i.e. walking devices) used by individuals to enhance their mobility have not changed significantly over the centuries. Statistics indicate that there are over ten million people in the United States alone that rely on the use of canes on a daily basis. Many of those individuals find their canes to be a cumbersome aid in improving their quality of life. While canes remain somewhat functional as ambulatory aids, they do not, except for serving to steady those who use them, address the practical requirements for mobility in the every day life of 21$^{st}$ century mankind.

The deficiencies inherent in the design of a typical cane are many. While a cane is intended to enhance an individual's mobility, it provides no assistance in rising from the ground. This is an all-too-common necessity among cane users, whether after intentionally kneeling, or in the event of a fall. The latter case is even more problematic if it happens when there is no one else around to offer any amount of assistance.

In addition, when a conventional cane is not being used it must be precisely positioned, perpendicular to the ground, against a vertical surface (e.g. wall, car door). Otherwise the cane will simply fall to the ground.

Conventional canes have a tip, or foot, (1) that is round in cross-section, (2) provides minimal surface contact due to its being flat on the bottom, (3) offers only minimal resistance to slip on wet surfaces due, in large part, to the aforementioned minimal surface contact, (4) cannot be utilized to traverse sand (e.g. at the beach), (5) cannot be used to hold open doors for passage by the cane's user, or as a courtesy to others, due to the typical presence of a circumferential protrusion positioned roughly ¼" to ⅜" from its bottom surface that gets caught under the edge of the door, and (6) generally wears out (requiring replacement) in two to three months.

Finally, by definition, the handle of a typical cane requires that it be grasped by one of the user's hands, thereby occupying that hand and preventing holding onto any one of a number of small, hand-held devices. An example of this dilemma is the opening of a car door. When a cane user carrying, for example, a briefcase in his/her other hand goes to unlock a car door, either the cane or the briefcase must be set aside in order to retrieve the car key, or keyless transmitter, required to gain access into the vehicle.

To the best of the knowledge of the present inventor, no prior cane design intended to address all of the problems outlined above exists. Consequently, it would be greatly advantageous to provide a cane that (1) provides the user with the ability to rise to a standing position (e.g. after falling) without requiring the assistance of another, (2) offers resistance to falling over when leaned against a vertical surface, (3) significantly improves the design and ergonomic utility of its foot, (4) possesses an ability to retain certain small devices, (5) possesses a simple, yet scalable, design fabricated of durable, lightweight materials, and (6) may be economically manufactured and sold to provide for widespread use.

SUMMARY OF THE INVENTION

It is, therefore, the primary object of the present invention to provide a cane possessing improved designs for the handle and foot.

A further object of the present invention is to provide an apparatus that provides a user with the ability to rise to a standing position without requiring assistance from another.

Yet another object of the present invention is to provide an apparatus that offers resistance to falling over when leaned against a vertical surface.

Another object of the present invention is to provide an apparatus that significantly improves the ergonomic utility of its foot.

A further object of the present invention is to provide an apparatus that possesses an ability to retain certain small devices.

Still another object of the present invention is to provide an apparatus that possesses a simple and scalable design.

It is another object of the present invention to provide an apparatus that is fabricated of lightweight materials providing an appropriate degree of durability/longevity.

An additional object of the present invention is to provide an apparatus that is inexpensive to manufacture and sell to provide for widespread use.

According to the present invention, the above-described and other objects are accomplished by a cane comprising a shaft, an ergonomic handle that includes multiple storage/retention zones, an emergency assist handle, and an ergonomically enhanced tip, or foot. The present invention is fabricated of lightweight materials chosen to provide an appropriate degree of durability/longevity. The present invention possesses a simple, yet scalable, design that may be economically manufactured and sold to provide for widespread use.

The emergency assist handle, when inserted into one of two sleeves located in the shaft, provides a user with a means for rising from the ground after a fall. The external, side surfaces of the ergonomic handle are formed with a textured material possessing a high coefficient of friction such that the cane may lean against virtually any vertical surface, at angles not precisely perpendicular to the ground, without falling over. The ergonomic handle of the present invention also includes a compartment, or retention zone, into which any number of small, hand-held devices (e.g. a car door lock's keyless transmitter) may be inserted.

The elongated foot of the present invention is fabricated of virtually indestructible materials also possessing, where appropriate, high coefficients of friction. The foot is radically different in size, length, and configuration and, thereby increases the area in contact with the surface being traversed by a user by up to 200%, without changing the "feel" of the cane. The surface of the tip intended for contact with the ground possesses a substantially linear central section with curved leading and trailing edges in order to maintain maximum contact between the foot and the surface being traversed as the handle swings in the arc generated by the movement of the user's hand while walking. The trailing edge extends 40% of the way up the rear side of the foot and the leading edge extends 40% of the way up the front. The improved tip design allows a user to traverse sand that is either wet (i.e. packed down by tidal action or at the water's edge) or dry (i.e. small undulations up to 10" high, such as those encountered on a typical beach), and loose gravel. The foot of the present invention eliminates the typical protrusion located approximately ¼" to ⅜" from the bottom surface that gets caught in the gap under the bottom edge of a door when the door is being held open by the cane for personal passage, or as a courtesy for another.

BRIEF DESCRIPTION OF THE DRAWINGS

Other objects, features, and advantages of the present invention will become more apparent from the following detailed description of the preferred embodiment and certain modifications thereof when taken together with the accompanying drawings in which.

DETAILED DESCRIPTION OF THE PREFERRED EMBODIMENTS

Figure 1:
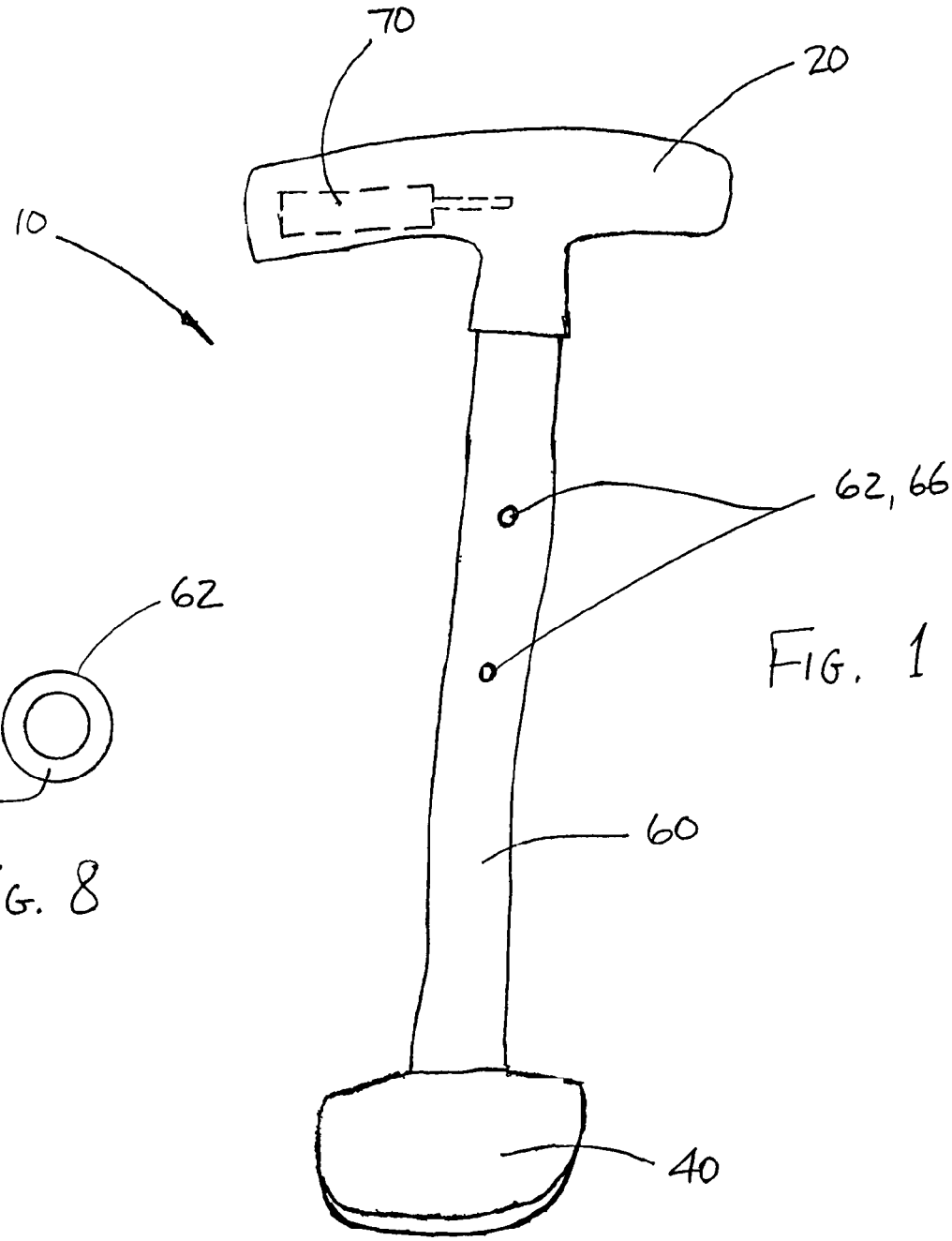
FIG. 1 is a side perspective view of a cane 10 according a preferred embodiment of the present invention.

FIG. 1 is a side perspective view of a cane 10 according to a preferred embodiment of the present invention. The cane 10 preferably comprises a shaft 60, an ergonomic handle 20 that includes multiple storage/retention zones (see discussion associated with FIGS. 2–4 below), an ergonomically enhanced tip, or foot 40, and an emergency assist handle 70.

The shaft 60 is defined by two grooves 68 (see FIGS. 3, 5, and 7) formed along its external surface, one proximate each opposing end. The two grooves 68 are preferably in linear alignment and serve as the point of contact with two set screws 64 threaded into the handle 20 and foot 40, respectively (discussed below—see FIGS. 3, 5, and 7) such that the handle 20 and foot 40 are properly aligned. The set screws 64 can be loosened and the handle 20 readjusted along the grooves 68 to allow the overall length of the cane 10 to be varied (see again the discussions below associated with FIGS. 3 and 7). The shaft 60 typically possesses a circular cross-section and is preferably fabricated of plastic or lightweight metal (e.g. aluminum) tubular stock. However, cross-sections other than circular (e.g. square) and metals other than aluminum may be utilized.

Two through holes 62 enter the shaft 60 along one side, through holes 62 preferably being located 18" to 24" from the bottom end of the shaft (i.e. where the shaft 60 attaches to the foot 40). The above-described grooves 68 are preferably located on the external surface of the shaft 60 in positions that represent a 90° angle from the central axis of the through holes 62. The 90° angle between the grooves 68 and holes 62 is required to establish the appropriate position for the use of an emergency assist handle 70 that attaches to the shaft 60 through the holes 62 (as discussed below).

Figure 8:
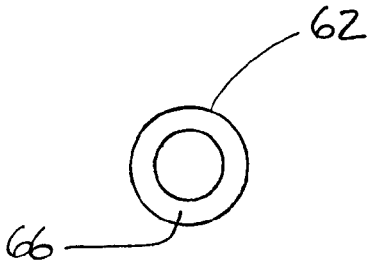
FIG. 8 is close-up view of the through hole 62 and the sleeve 66 of FIG. 1.

As indicated in the close-up view of FIG. 8, two metal sleeves 66 are press fit into the two holes 62, such that ends of the sleeves 66 are flush with the ends of the holes 62 (or the opposing surfaces of the shaft 60). The metal sleeves 66 are preferably short sections of hardened steel tubing (i.e. short, hardened steel cylinders), cut to a length that matches the thickness of the shaft 60 at the point where the holes 62 are formed. The outside diameter of each sleeve 66 is slightly larger (i.e. a few thousandths of an inch) than the diameter of a hole 62 such that a friction fit is created when the sleeve 66 is forced into the hole 62. The inside diameter of each sleeve 66 is slightly larger than the outside diameter of the shaft 74 of the emergency assist handle 70 (discussed below). Given that the material used in the fabrication of the shaft 60 is typically a relatively soft material (i.e. plastic or aluminum as stated above), the presence of the sleeves 66 in the holes 62 serves to prevent any deformation of the holes 62/shaft 60 due to the forces/pressures generated by the use of the emergency assist handle 70 (see discussion below). While hardened steel is preferred for the sleeves 66, any material possessing the durability to withstand the forces/pressures generated by the use of the emergency assist handle 70, while preventing any deformation of the holes 62, may be utilized.

Figure 2:
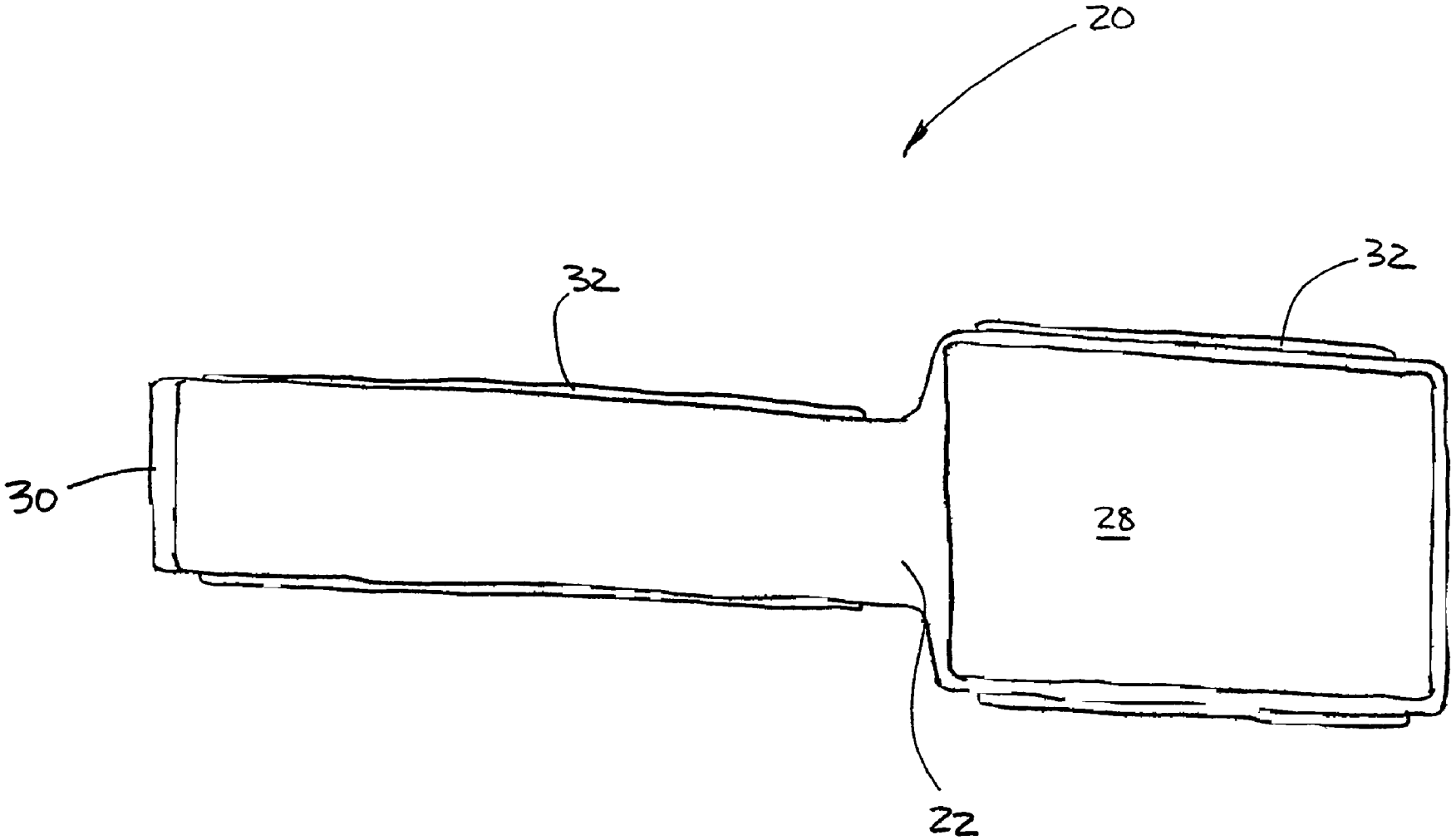
FIG. 2 is a top perspective view of an ergonomic handle 20 according a preferred embodiment of the present invention.
Figures 3, 4:
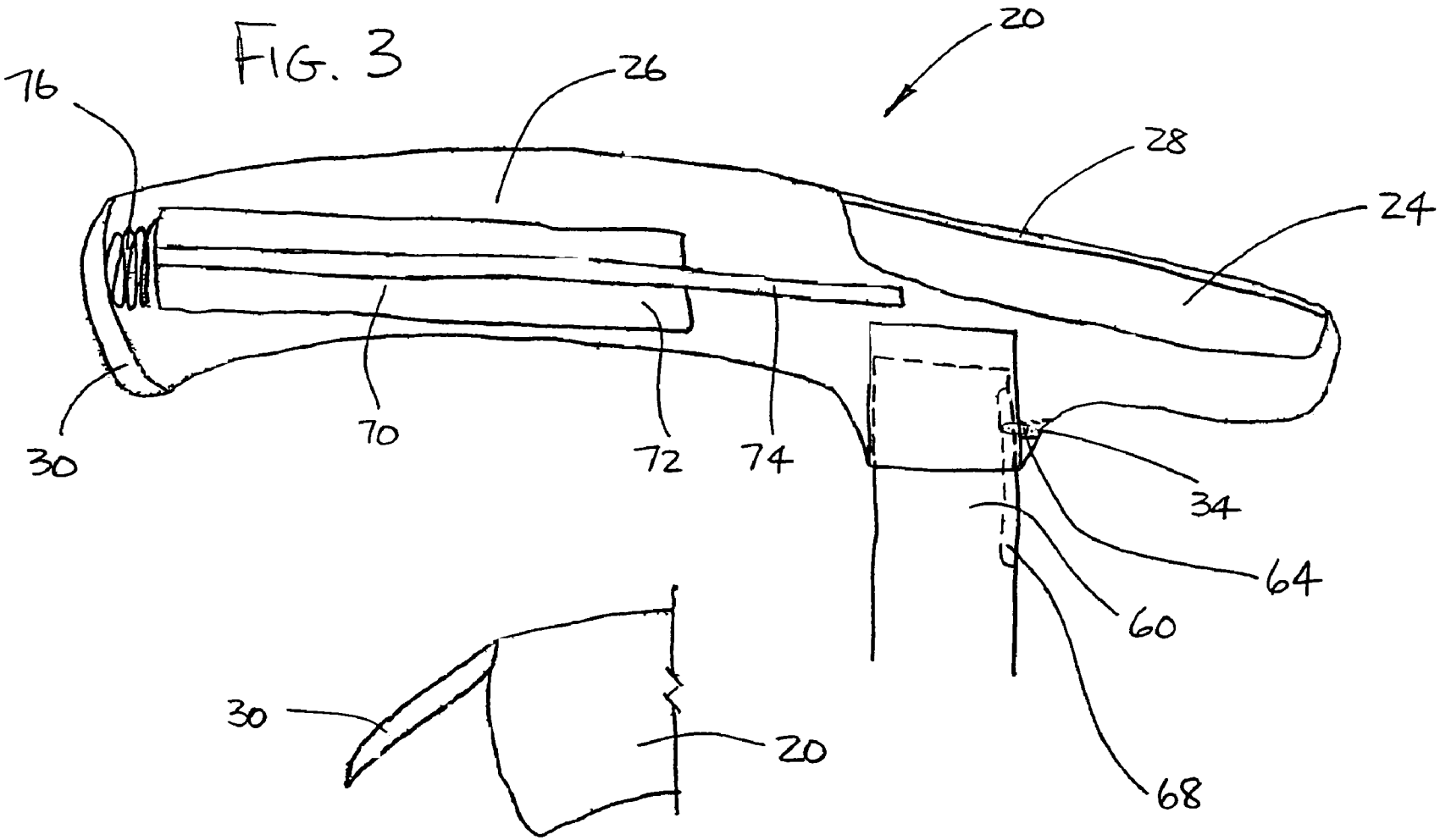
FIG. 3 is a side, cross-sectional view of the ergonomic handle 20 of FIG. 2.
FIG. 4 is a close-up, side perspective view of an end the ergonomic handle 20 of FIGS. 2 and 3 showing an access door 30.

FIGS. 2 and 3 are, respectively, top perspective and side cross-sectional views of the ergonomic handle 20 according a preferred embodiment of the present invention. The ergonomic handle 20 typically comprises a body 22, two compartments, or retention zones 24, 26, two access doors 28, 30, textured external side surfaces 32, and a threaded hole 34 equipped with a set screw 64. The body 22 is preferably fabricated from a commercially available, injection moldable plastic such as LEXAN® polycarbonate available from General Electric Company of Pittsfield, MA. However, any strong, lightweight material, such as another plastic material or a metal (e.g. aluminum), that can be formed into the shape of the body 22 of the present invention may be utilized.

The external side surfaces 32 of the ergonomic handle 20 are preferably formed with a textured, rubber material possessing a high coefficient of friction such as that available from Soucy Baron Inc. of Saint-Jérôme, Québec (Canada) as part no. J7033CxJ315W. However, any lightweight material possessing appropriate frictional properties and the ability to be molded into the required form may be utilized. The material of the side surfaces 32 is fixedly attached to the body 22 (e.g. glued, molded) and allow the cane 10 to be leaned against virtually any vertical surface, at angles not precisely perpendicular to the ground, without falling over. The cane's resistance to falling over is further enhanced because the configuration of the ergonomic handle 20 increases the contact area between either of the side surfaces 32 and a vertical surface by more than 100% as compared to traditional cane handles.

The ergonomic handle 20 of the present invention includes two compartments, or retention zones 24, 26. Compartment 24, located at the front of the handle 20, is equipped with an access cover 28 preferably fabricated of a pliable, translucent plastic material that may be either hingedly attached to the body 22, and/or removably attached to the body 22 via a frictional fit. Both attachment means preferably provide a user with the ability to completely detach the cover 28 from the body 22 if so desired. The compartment 24 is configured such that one of any number of small, hand-held devices (e.g. a car door lock's keyless transmitter, a small lithium powered flashlight) may be temporarily, or permanently, seated therein and operated, through the pliable cover 28, by the thumb of the user's hand that is holding the cane 10.

Access to the compartment 26 located at the rear of the handle 20 is provided by door 30. The access door 30 is preferably fabricated of the same material as the body 22 and, as shown in FIG. 4, is hingedly attached to the body 22 of the handle 20. Alternatively, the door 30 may be formed with external threads and the body 22 formed with internal threads to provide for a threaded connection between the two components. The compartment 26 is configured to house the emergency assist handle 70 discussed below.

The threaded hole 34 and set screw 64 are located toward the front of the handle 20 underneath the front compartment 24. When the hole 34 and set screw 64 are aligned with the groove 68 located proximate the top end of the shaft 60, and the set screw 64 is seated into that groove 68, the proper orientation between the handle 20 and the shaft 60 is achieved. The overall length of the cane 10 may be adjusted by repositioning the set screw 64 within the groove 68 to vary the depth to which the shaft 60 is inserted into the handle 20.

The configuration of the ergonomic handle 20 preferably conforms to the natural arc of the palm of a user's hand. This provides for significantly greater comfort by reducing muscle strain and the probability of nerve or muscular damage when holding/using the cane 10 on a regular basis.

Figure 5:
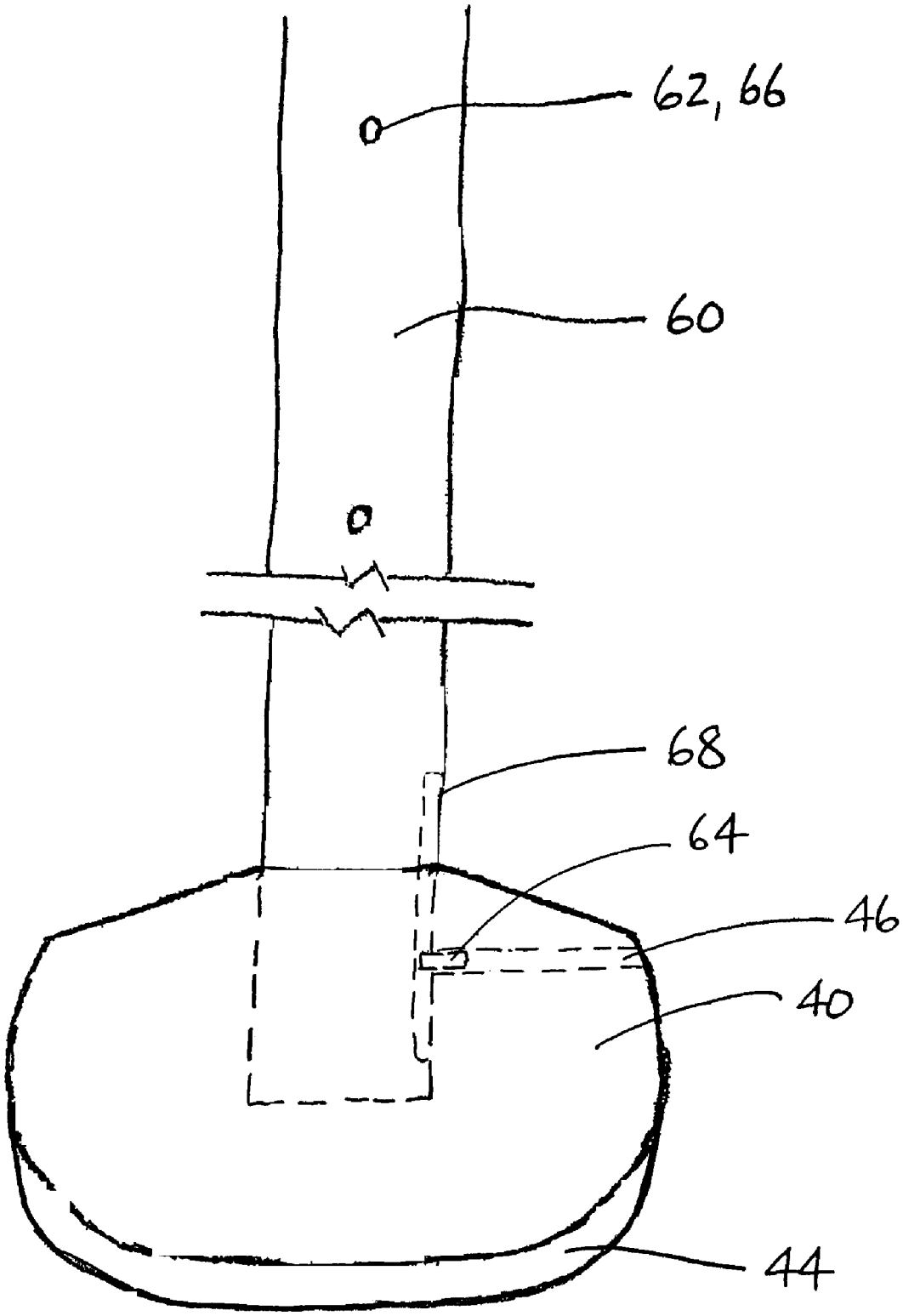
FIG. 5 is a side perspective view of a foot 40 and part of a shaft 60.
Figure 7:
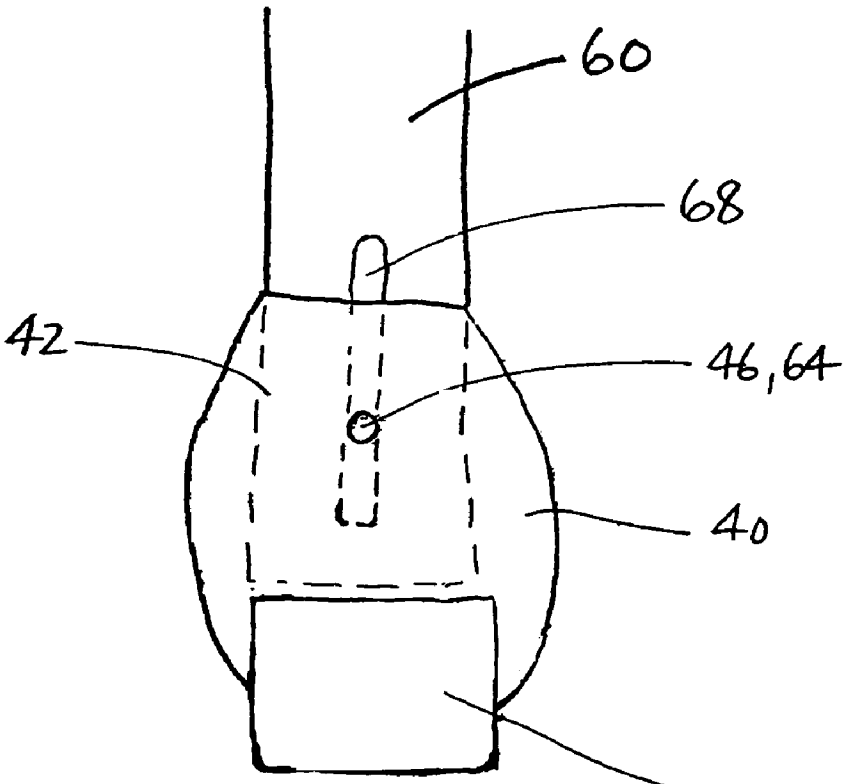
FIG. 7 is a front perspective view of the foot 40 and part of the shaft 60 of FIGS. 5 and 6.
Figure 6:
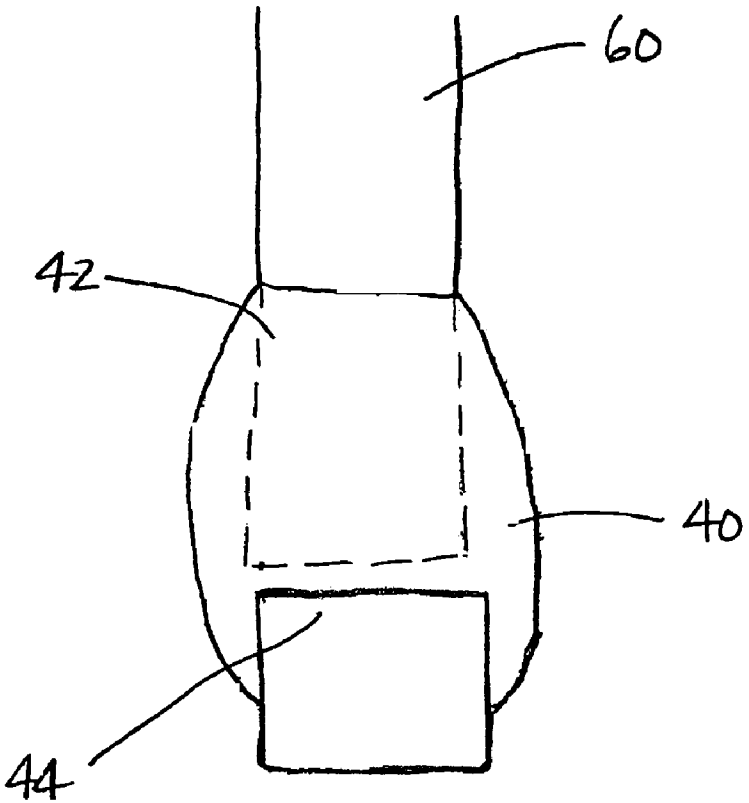
FIG. 6 is a rear perspective view of the foot 40 and part of the shaft 60 of FIG. 5.

FIGS. 5–7 are, respectively, side, rear, and front perspective views of the foot 40 at the bottom end of the shaft 60. The foot 40 of the present invention generally comprises a body 42, a sole 44, and a threaded hole 46 equipped with a set screw 64. The body 42 is preferably fabricated of a commercially available, injection moldable plastic such as LEXAN® polycarbonate available from General Electric Company of Pittsfield, Mass. However, any durable, lightweight material that can be formed into the shape of the body 42 may be utilized. The rubber material of the sole 44 is preferably that available from Soucy Baron Inc. of Saint-Jérôme, Québec (Canada) as part no. J7033CXJ315W. This rubber compound has been chosen due to its slip resistant formulation and its track record during many years of worldwide use.

The sole 44 is fixedly attached within a recess formed in the body 42. The sole 44 extends downward out of the recess, but does not extend outward beyond any point along the side of the body 42. This recessed construction eliminates the outward protrusion typically located the side of a traditional cane tip/foot approximately ¼" to ⅜" from the bottom. That typical outward protrusion repeatedly gets caught in the gap under the bottom edge of a door when the door is being held open by the cane for personal passage, or as a courtesy for another. Therefore, the cane 10 of the present invention may be used to hold any door open without getting the foot 40 caught under the bottom of the door.

The threaded hole 46 and set screw 64 are located toward the front of the foot 40. When the hole 46 and set screw 64 are aligned with the groove located proximate the bottom end of the shaft 60, and the set screw 64 is seated into that groove, the proper orientation between the foot 40 and the shaft 60 is achieved. The overall length of the cane 10 may be adjusted by repositioning the set screw 64 within the groove to vary the depth to which the shaft 60 is inserted into the foot 40.

The elongated foot 40 of the present invention is fabricated of virtually indestructible materials possessing high coefficients of friction. The foot 40 is radically different in size, length, and configuration and, thereby increases the area in contact with the surface being traversed by a user by up to 200%, without changing the "feel" of the cane 10. The surface 44 of the foot 40 intended for contact with the ground possesses a substantially linear central section with curved leading and trailing edges in order to maintain maximum contact between the foot 40 and the surface being traversed as the handle swings in the arc generated by the movement of the user's hand while walking. The trailing edge preferably extends 40% of the way up the rear side (see FIG. 6) of the foot and the leading edge preferably extends 40% of the way up the front (see FIG. 7). The contour of the foot 40 allows it to substantially reproduce the action of the user's foot (i.e. the heel makes contacts with the ground first, followed by the sole of the foot, before finishing with the toes). This configuration also provides for maximum wear life of the foot 40.

Regardless of the length of one's stride, the present invention's foot 40 strikes the ground at an angle of approximately 15° from the vertical, then passes through a vertical axis to a position approximately 15° on the other side of the vertical, where it typically leaves the ground as it propels or assists the user in moving forward. The foot 40 maintains maximum contact with the ground during the entire 30° of cane rotation. The curved configuration of the foot 40 of the present invention provides continuous, maximum of contact between the cane 10 and the ground during the walking process without modifying, in any appreciable way, the balance or feel of the cane 10.

The improved foot 40 of the present invention allows a user to traverse a wide variety of terrain including sand that is either wet (i.e. packed down by tidal action or at the water's edge) or dry (i.e. small undulations up to 10" high, such as those encountered on a typical beach), and loose gravel. The larger footprint allows for safer functional use in wet and/or slippery conditions.

The emergency assist handle 70 (see FIG. 3) generally comprises a body 72, a shaft 74, and a strap 76. The body 72 is preferably formed with a circular cross-section and fabricated of a commercially available, injection moldable plastic such as LEXAN® polycarbonate available from General Electric Company of Pittsfield, Mass. However, cross-sections other than circular, and any strong, lightweight material (e.g. aluminum) that can be formed as required by the shape of the body 72 may be utilized. The shaft 74 is preferably fabricated of hardened steel and extends completely through, and is fixedly attached to, the body 72 such that its central axis is collinear with the central axis of the body 72. The shaft 74, however, may be fabricated of any material possessing the durability to withstand the forces/pressures generated by the use of the emergency assist handle 70 (see discussion below). One end of the strap 76 is fixedly attached to the other end of the body 74. The strap 76 is preferably fabricated from commercially available NYLON® cord. However, any flexible, lightweight material may be utilized.

The emergency assist handle 70, when not in use, is preferably stored in the rear compartment 26 of the handle 20 (see again FIG. 3) with the strap 76 folded and positioned directly behind access door 30. In the event of a fall (when there are no others around to render assistance), the user may readily access the emergency assist handle 70 located in the ergonomic handle 20 by opening the access door 30 and pulling on the folded strap 76. After removing the emergency assist handle 70 from the compartment 26, the shaft 74 is fully inserted (i.e. such that the body 72 abuts the shaft 60) into one of the sleeves 66 located in the shaft 60 of the cane 10. This positions the emergency assist handle 70 perpendicular to the ergonomic handle 20 and at a height above the ground that allows the user with a means for getting himself/herself back on his/her feet. The assist handle 70 is capable of bearing up to 300 pounds of weight.

Once the user is back on his/her feet, the handle 70 is detached from the sleeve 66 in the shaft 60 and placed back into its storage compartment 26. The strap 76 is then folded and the access door 30 is closed. The emergency assist handle 70 is now back in its compartment 26 and ready for the next time it is needed.

In an alternative embodiment of the emergency assist handle 70, one end of the body 72 (that opposite the protrusion of the shaft 74) is formed with external threads and the body 22 of the ergonomic handle 20 is formed with internal threads to provide for a direct threaded connection between the two handles 20, 70. This alternative embodiment provides for the elimination of the rear access door 30 and the strap 76.

The present invention incorporates significant developments that allow all cane users to comfortably and safely traverse surfaces as varied as flat ground, polished marble or terrazzo floors, sand, gravel, and other uneven areas with safety and confidence. The cane 10 also allows the user to safely and easily hold doors open for others, to rise from the ground unassisted after a fall, and, for example, gain access to a vehicle without having to temporarily set down any item(s) being carried in the hand not holding onto the cane in order to retrieve the keyless entry device from a pocket. The present invention is fabricated of strong, lightweight materials chosen to provide an appropriate degree of durability/longevity. The present invention possesses a simple, yet scalable, design that may be economically manufactured and sold to provide for widespread use.

Having now fully set forth the preferred embodiments and certain modifications of the concept underlying the present invention, various other embodiments as well as certain variations and modifications of the embodiments herein shown and described will obviously occur to those skilled in the art upon becoming familiar with said underlying concept. It is to be understood, therefore, that the invention may be practiced otherwise than as specifically set forth in the appended claims.

I claim:

1. A cane, comprising:

a shaft, said shaft comprising at least two sleeves extending therethrough;

a first handle detachably attached to a first end of said shaft, said first handle comprising at least two compartments;

a foot detachably attached to a second end of said shaft; and a second handle, said second handle formed for temporary, sliding engagement with one of said at least two sleeves in said shaft, and stored in one of said at least two compartments in said first handle when not slidably engaged with one of said at least two sleeves.

2. The cane according to claim 1, wherein said shaft further comprises a first groove proximate said first end and a second groove proximate said second end, said first and second grooves being linearly aligned and formed in the outer surface of said shaft in positions that are 90° from the central axes of said sleeves.

3. The cane according to claim 2, wherein said first handle further comprises a cavity and a threaded hole positioned perpendicular to said cavity to facilitate the detachable attachment of said first handle to said shaft.

4. The cane according to claim 3, wherein said foot further comprises a cavity and a threaded hole positioned perpendicular to said cavity to facilitate the detachable attachment of said foot to said shaft.

5. The cane according to claim 4, wherein said cane further comprises first and second set screws, said first set screw being threadably engaged with said hole in said first handle and seated in said first groove in said shaft to establish appropriate alignment and relative position between said first handle and said shaft, and said second set screw being threadingly engaged with said hole in said foot and seated in said second groove in said shaft to establish appropriate alignment and relative position between said foot and said shaft.

6. The cane according to claim 1, wherein said at least two sleeves are located 18" to 24" from said second end of said shaft.

7. The cane according to claim 1, wherein said first handle further comprises an ergonomic design conforming to the natural arc of a user's palm, thereby providing significantly greater comfort by reducing muscle strain and the probability of nerve or muscular damage when holding/using said cane on a regular basis.

8. The cane according to claim 1, wherein said first handle further comprises one or more doors that are hingedly attached to said first handle and provide access to one or more of said at least two compartments.

9. The cane according to claim 1, wherein said first handle further comprises textured external side surfaces.

10. The cane according to claim 9, wherein said textured external side surfaces are fabricated of a slip resistant rubber material possessing a high coefficient of friction.

11. The cane according to claim 1, wherein said foot further comprises a body formed with a recessed area and a sole fixedly attached within said recessed area of said body.

12. The cane according to claim 11, wherein said sole is fabricated of a slip resistant rubber material possessing a high coefficient of friction.

13. The cane according to claim 11, wherein a leading edge of said sole extends along a front side of said body from the bottom of said foot to a point equal to approximately 60% of said foot's overall height.

14. The cane according to claim 11, wherein a trailing edge of said sole extends along a rear side of said body from the bottom of said foot to a point equal to approximately 50% to 60% of said foot's overall height.

15. The cane according to claim 1, wherein said second handle further comprises a body, a strap wherein one end of said strap is fixedly attached to a first end of said body, and a shaft fixedly attached to said body and extending out of a second end of said body.

16. The cane according to claim 15, wherein the central axis of said shaft is collinear with the central axis of said body.

17. The cane according to claim 15, wherein said at least two sleeves are hardened steel cylinders open at both ends and said shaft of said second handle is a hardened steel rod sized to fit within any of said at least two sleeves.

18. The cane according to claim 1, wherein said second handle further comprises a body formed with external threads at a first end of said body for threaded engagement within one of said two or more compartments in said first handle, and a shaft fixedly attached to said body and extending out of a second end of said body.

19. A cane, comprising:

a shaft having a top end and a bottom end, and a receptacle spaced there between along one side;

a fixed handle attached to one end of said shaft, said fixed handle comprising at least one compartment;

an emergency assist handle removably seated in the compartment of said fixed handle for alternative storage therein, or for removal and lateral connection to the receptacle of said shaft to thereby provide a user with bi-level hand support to facilitate standing up from a down position.

20. The cane according to claim 19, wherein said receptacle is located within a range of from 18" to 24" from said bottom end.

21. The cane according to claim 20, wherein said fixed handle further comprises a cavity and a threaded hole positioned perpendicular to said cavity to facilitate the detachable attachment of said emergency assist handle to said shaft.

22. The cane according to claim 21, wherein said receptacle further comprises a threaded hole oriented perpendicular to said shaft to facilitate the detachable attachment of said emergency assist handle.

23. The cane according to claim 22, further comprising a plurality of receptacles spaced lengthwise along said shaft and each further comprising a threaded hole oriented perpendicular to said shaft to facilitate the detachable attachment of said emergency assist handle.

24. The cane according to claim 19, further comprising a foot mounted on the bottom end of said shaft and further comprising a body formed with a recessed area and a sole fixedly attached within said recessed area of said body.

25. The cane according to claim 24, wherein said sole is fabricated of a slip resistant rubber material possessing a high coefficient of friction.

26. The cane according to claim 25, wherein a leading edge of said sole extends along a front side of said body from the bottom of said foot to a point equal to approximately 60% of said foot's overall height.

27. The cane according to claim 26, wherein a trailing edge of said sole extends along a rear side of said body from the bottom of said foot to a point equal to approximately 50% to 60% of said foot's overall height.

* * * * *